US005743838A

United States Patent [19]

Willis

[11] Patent Number: 5,743,838

[45] Date of Patent: Apr. 28, 1998

[54] EXERCISE SYSTEM

[76] Inventor: James E. Willis, 528 McNally Dr., Prescott, Ariz. 86301

[21] Appl. No.: 747,775

[22] Filed: Nov. 13, 1996

[51] Int. Cl.[6] ..... A63B 21/02

[52] U.S. Cl. ..... 482/124; 482/125; 482/129

[58] Field of Search ..... 482/121, 122, 482/124, 125, 129

[56] References Cited

U.S. PATENT DOCUMENTS

| | | | |
|---|---|---|---|
| 1,506,631 | 8/1924 | Grover . | |
| 4,073,490 | 2/1978 | Feather | 482/129 |
| 4,090,706 | 5/1978 | Reda . | |
| 4,478,414 | 10/1984 | Molloy . | |
| 4,685,671 | 8/1987 | Hagerman et al. . | |
| 4,930,767 | 6/1990 | Hamm . | |
| 5,129,647 | 7/1992 | Castellanos . | |
| 5,141,482 | 8/1992 | Hern . | |
| 5,153,959 | 10/1992 | Fitzsimmons . | |
| 5,203,754 | 4/1993 | MacLean . | |
| 5,234,394 | 8/1993 | Wilkinson . | |
| 5,336,151 | 8/1994 | Van Ballagooie . | |

*Primary Examiner*—L. Reichard
*Attorney, Agent, or Firm*—Parsons & Goltry; Robert A. Parsons; Michael W. Goltry

[57] ABSTRACT

A method and apparatus for an exercising device. The exercising device includes an elongated flexible body having a first extremity and a second extremity disposed to either side of a central portion and an elongated elastic member. The elongated elastic member includes a first end and a second end. The first and second ends are (i) adapted to accommodate a human limb and (ii) adapted to removably couple to the central portion of the elongated flexible body. A plurality of ring structures are disposed along an axis extending between the first extremity and the second extremity of the elongated flexible body, a first clip is disposed at the first end of the elongated elastic member and a second clip is disposed at the second end of the elongated elastic member. The first and second clips are adapted to couple the first and the second ends of the elongated elastic member to ones of the plurality of ring structures. The plurality of ring structures desirably includes a piece of cloth material sewn to the body so as to permanently capture flat portions of D-rings and attach the D-rings along the axis and to the elongated flexible body.

25 Claims, 4 Drawing Sheets

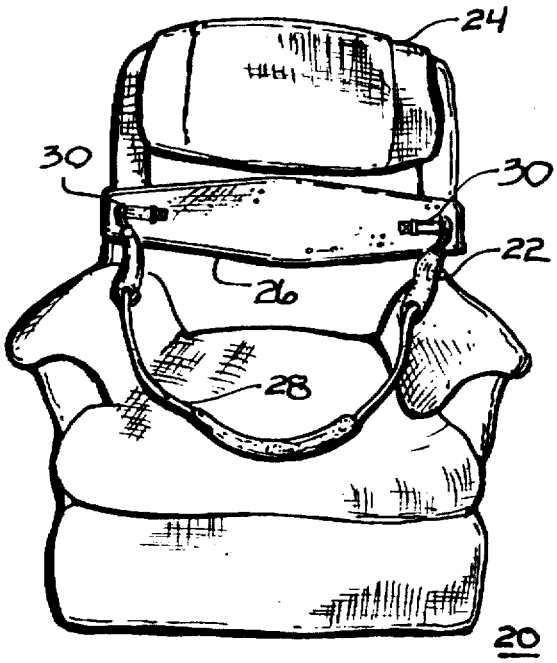
FIG. 1
FIG. 2
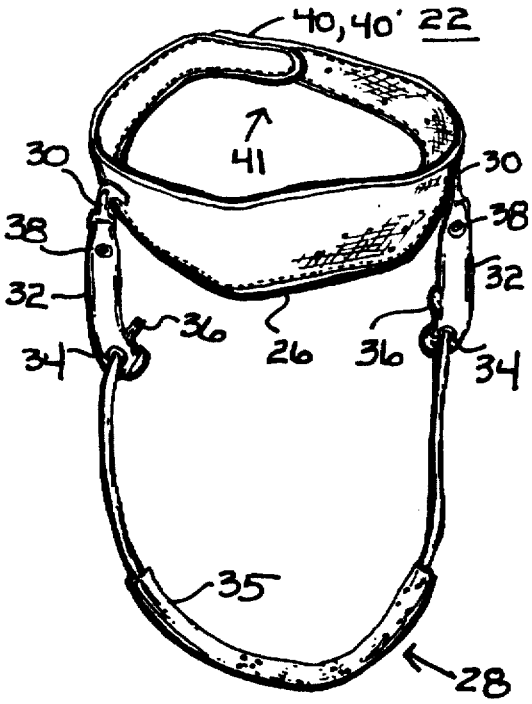
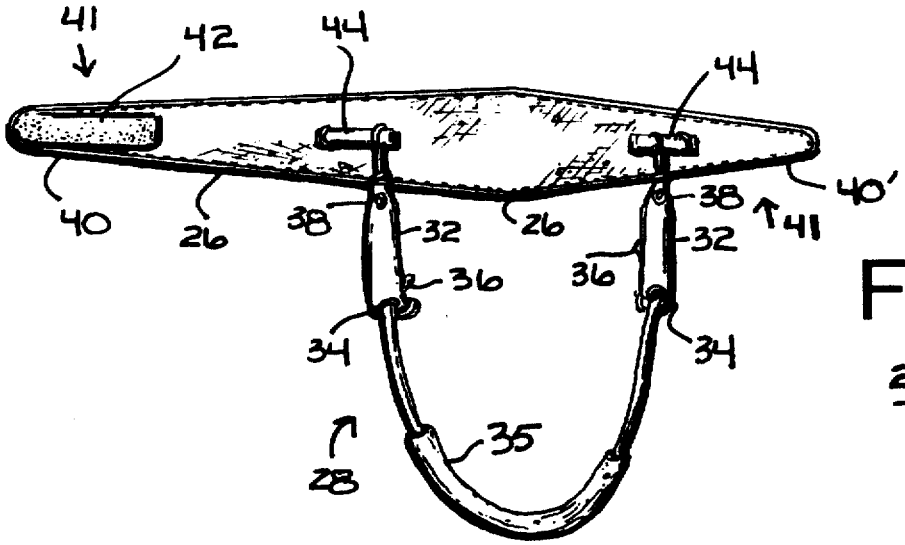
FIG. 3
22

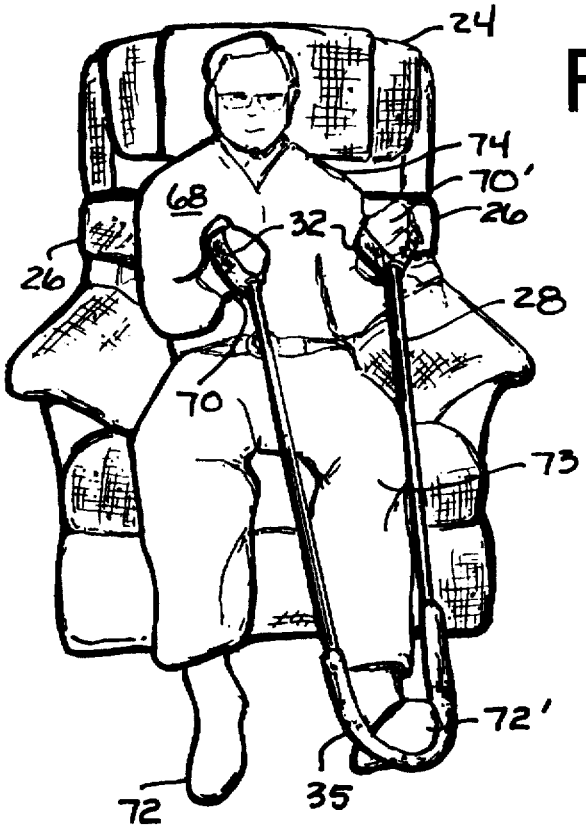
FIG. 7
FIG. 8
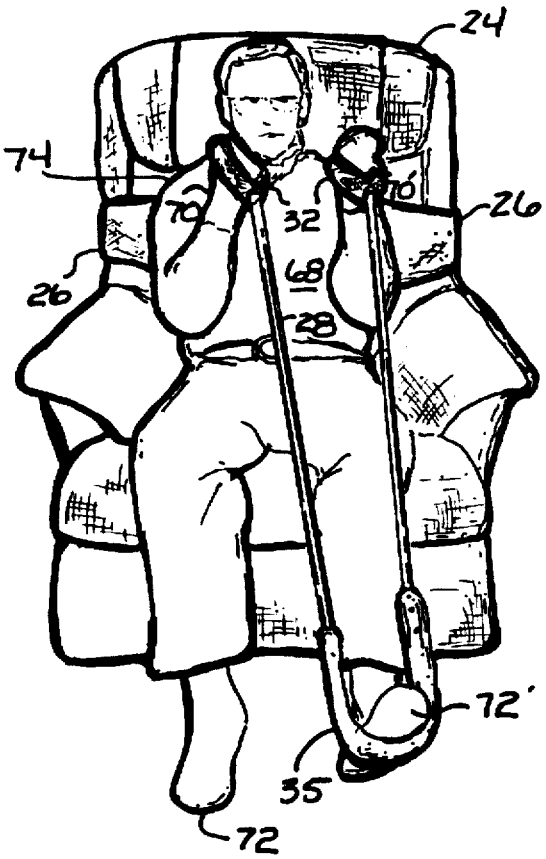
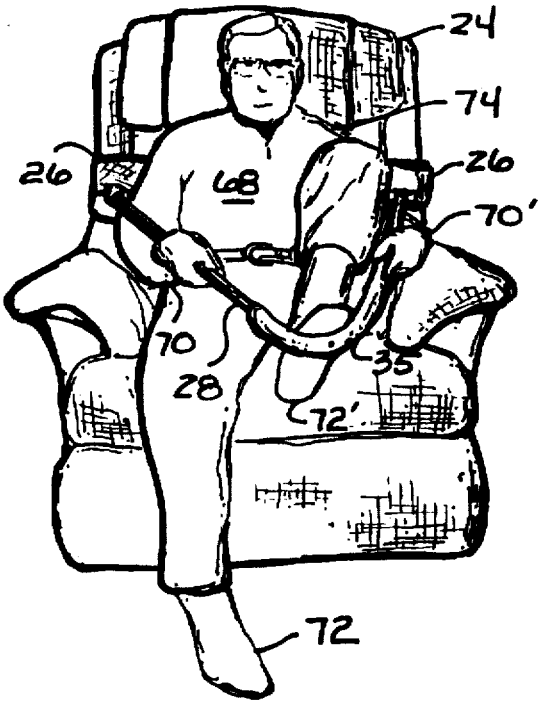
FIG. 9

EXERCISE SYSTEM

BACKGROUND OF THE INVENTION

1. Field of the Invention

This invention relates to a method, apparatus and system for exercising.

More particularly, the present invention relates to an exercising apparatus that may be operated alone or in conjunction with a chair, for example.

In a further and more specific aspect, the instant invention concerns a method and apparatus for exercising that may be detachably coupled to another object, such as an article of furniture, that need not inhibit normal use of the article of furniture.

2. Prior Art

Exercising devices are increasingly needed because modern jobs tend to promote a sedentary work day. Fitness centers and the like represent a continuous expense and also require the individual to travel to and from the fitness center or gymnasium. Many of the exercise devices that are available are large, therefore taking up a significant amount of the space in the home, and are also expensive. These may be limited in the types of exercise to which they are adapted. Also, neither of these options (i.e., fitness centers and gymnasia) is portable and so they cannot be taken along when a person is traveling.

Accordingly, there is an increasing need for light weight, versatile exercising devices that allow or promote a broad variety of exercises for different muscle groups. There is also increased need for exercise devices that do not require large portions of the home of the owner of the device in order to be used or stored.

An example of an exercising device having various components designed and intended to be coupled to the body of the individual who is exercising is described in U.S. Pat. No. 5,336,151, entitled "Body Exercise Device", issued to Paul Van Ballegoolie. The exercising device includes a waist belt designed to be releasably fastened about the individual's waist and having a plurality of snap rings pivotally attached to the belt at spaced intervals throughout its length to provide different attachment locations for elongated elastic members. The elongated elastic members include snap hooks connected at opposing ends of the elastic members. Also included are foot pieces each having snap rings disposed thereon for detachably coupling to a snap hook at the end of an elastic member. Further included are hand pieces each including a hand-encircling component and a wrist protection component.

Other examples of exercising devices having various components designed and intended to be coupled to the body of the individual who is exercising are described in U.S. Pat. No. 4,930,767, entitled "Therapeutic Device", issued to Ronald L. Hamm; U.S. Pat. No. 5,129,647, entitled "Elastic Resistance Exerciser Secured At The Waist", issued to Edward Castellanos; and U.S. Pat. No. 5,203,754, entitled "Variable Resistance Leg Harness Exercise Device", issued to Colin R. Maclean.

A disadvantage of these devices is that they must be put on and taken off prior to and after each exercise session. Another disadvantage is that they couple only to the exercising individual's body and so do not facilitate certain types of exercises where the individual is pushing or pulling against a fixed object. A further disadvantage is that they must be put away after each use and must be retrieved from storage before each use.

Other examples comprising loops intended to couple different body parts to each other or to a fixed object such as a bed are described in U.S. Pat. No. 4,478,414, entitled "Elastic Ankle And Knee Exerciser", issued to Lawrence Molloy; U.S. Pat. No. 4,090,706, entitled "Belt Tension Exerciser", issued to Ronald Reda; and U.S. Pat. No. 5,153,959, entitled "Method And Apparatus For Patient Assisted Movements In Convalescing Bed", issued to John Fitzsimmons.

These devices are intended to allow exercise of specific muscle groups or to couple to a limited number of body components at one time and so cannot provide for a large range of different exercises. Moreover, they must be attached to or coupled to the different elements with each session.

Further examples are taught in U.S. Pat. No. 5,141,482, entitled "Seat Exerciser Device", issued to James Hern and U.S. Pat. No. 5,234,394 entitled, "Universal, Portable Exercise Apparatus Adaptable to Fit A Chair", issued to William Wilkinson. These two patents describe devices that are coupled specifically to chairs and to the upper body and so are limited in application to exercises for the upper body and/or arms. The exercise devices described in these two patents are poorly suited to exercises other than the specific exercises and muscle groups for which they are designed and intended.

A feature common to many of these systems is a means for wrapping or strapping a portion of the body of the user in order to couple the exercise apparatus to the user's body. Among other things, a disadvantage of these types of exercise apparatus is that the user must retrieve the exercise apparatus and put the exercising apparatus on at the beginning of the session and also must take the exercising apparatus off and put the exercising apparatus away at the end of the session.

In order to combat these varied problems, some form of exercising device that couples to an existing structure within the home or office and that does not interfere with normal usage of the structure, even when the exercise device is attached, is desirable. This type of an arrangement could solve some of the problems associated with exercise devices from the prior art.

While the various mentioned prior art devices function as apparatus for exercising in the home or office, certain inherent deficiencies preclude adequate, satisfactory performance of the purpose of exercising when the person is traveling. Ideally, a light-weight, compact, readily attachable and detachable device could fit into a day bag or other luggage with minimal volume and weight demands and would be readily adaptable and de- and re-attachable to structures commonly found in public accommodations, preferably world-wide.

Accordingly, it is desirable, particularly with respect to in-home exercising, to provide an exercise device that is light-weight, easily coupled to existing structures such as furniture, that does not interfere with the use of the existing structure even when left coupled thereto and which is capable of exercising a broad variety of muscle groups. Additionally, it is desirable to be able to easily and rapidly reconfigure the exercise device for working on or exercising different muscle groups within the body. It is additionally desirable to be able to provide an exercise device that is useful and user-friendly to persons of all ages. Moreover, it is desirable that the exercise device lend itself to being readily and easily cleaned from time to time.

Further, the situations in which people engage in in-home or in-office exercise are also situations in which the individual may need to interrupt the exercise session with some frequency. Accordingly, it is desirable to be able to disengage the exercise device with as little fuss as is possible.

Accordingly, it is desirable to provide for a variety of exercises in which one portion of the body is exerted against another portion of the body. However, this alone is not necessarily sufficient because it is desirable to be able to exert a body member against a fixed object for some types of exercises or muscle groups.

It would be highly advantageous, therefore, to remedy the foregoing and other deficiencies inherent in the prior art.

Accordingly, it is an object of the present invention to provide improvements in exercise apparatus.

Another object of the present invention is the provision of an improved method and apparatus for de- and re-attaching a portable exercise device to a broad variety of fixtures or structures encountered in most common settings.

An additional object of the instant invention is the provision of an improved method and apparatus for providing a portable exercise device that is readily and easily reconfigurable for exercising a broad variety of different muscle groups.

A further additional object of the present invention is to provide an exercise device that is amenable to, and useful for, providing exercise for individuals of varying age and physical capacity.

Still a further additional object of the present invention is to provide an improved method, apparatus and system for a light-weight exercise apparatus that de- and re-attachably couples to existing in-home structures and that does not interfere with normal use of the in-home structures, even when the exercise device is coupled thereto.

And another object of the present invention is to provide an improved method, apparatus and system for exercising that has minimal volume and weight and that can be readily stowed in even a relatively small piece of hand luggage.

And yet another object of the instant invention is to provide a light-weight, portable exercising device that is readily washable.

Still another object of the present invention is the provision of a method, system and apparatus for exercising that is easily and readily disengaged from the user without requiring an unduly large number of operations.

Yet another object of the instant invention is to provide a method, system and apparatus for exercising that is useful in conjunction with an existing structure, such as a piece of furniture, and that is also useful as a stand-alone exercising device.

Yet still another object of the instant invention is the provision of a method, system and apparatus for exercising that lends itself to travel and that accommodates exercises intended to develop a broad variety of muscle groups.

And a further object of the invention is to provide a method, system and apparatus for exercising that is lightweight, that is easily engaged and disengaged from the exercising individual, that is readily transportable and that is adapted to detachably couple to a piece of furniture without interfering with normal usage or operations of the piece of furniture.

Still a further object of the immediate invention is the provision of a method, apparatus and system for exercising that is adapted to both allow exercising one portion of the body against another portion thereof and to exercising one or more body portions against a fixed object such as a piece of furniture.

Yet a further object of the invention is to provide a new system and method for exercising whereby the individual and the exercise apparatus are readily and easily disengaged and re-engaged or detached and re-attached from one another and from any ancillary object employed as a fixed object against which to exercise.

And still a further object of the invention is the provision of method and apparatus, according to the foregoing, which is intended to allow exercise of a plurality of differing muscle groups with minimal reconfiguration, that detachably couples to existing and broadly-distributed furniture, that is adapted to avoid interfering with normal usage or operation of the furniture to which is it coupled even when coupled thereto, which is also capable of providing exercise in a stand-alone configuration and which is light-weight and compact and therefore lends itself to use in home, office or when traveling.

SUMMARY OF THE INVENTION

Briefly, to achieve the desired objects of the instant invention in accordance with a first preferred embodiment thereof, provided is a method and an apparatus for exercising. The method includes steps of providing an elongated flexible body having a first extremity and a second extremity disposed to either side of a central portion and providing an elongated elastic member. The elongated elastic member includes a first end and a second end. The first and second ends are (i) adapted to accommodate a human limb and (ii) adapted to removably couple to the central portion of the elongated flexible body.

The method desirably but not essentially also includes steps of disposing a plurality of ring structures along an axis extending between the first extremity and the second extremity of the elongated flexible body, disposing a first clip at the first end of the elongated elastic member and disposing a second clip at the second end of the elongated elastic member, wherein the first and second clips are adapted to couple the first and the second ends of the elongated elastic member to ones of the plurality of ring structures.

The method optionally includes a step of sewing a piece of cloth material to the elongated flexible body of the exercise device so as to permanently capture flat portions of D-rings and attach the D-rings along the axis extending between the first extremity and the second extremity of the elongated flexible body, and to the elongated flexible body, and the step of providing a flexible elongated body desirably includes a step of providing a flexible elongated cloth body.

The method desirably further comprises a step of providing a strap adapted to be coupled to an end of the elongated elastic member, wherein the strap has a length of between six inches and twelve inches, wherein the strap includes a first sewn bight at one extremity thereof. The first sewn bight desirably captures a ring coupled to a clip, wherein the strap includes a second sewn bight at another extremity thereof. The second sewn bight desirably captures a D-ring adapted to couple to the clip to form a continuous closed loop.

The method desirably but not essentially includes a step of providing a strap having a grommet affixed thereto, wherein the grommet includes an interior diameter that is larger than an exterior diameter of the elongated elastic member, and wherein the interior diameter is smaller than a knot tied in an end of the elongated elastic member.

The method usefully further comprises steps of providing a protective layer disposed about a midsection of the elongated elastic member and providing an elongated elastic member chosen from the group consisting of surgical tubing, rubber cord and woven elastic cord.

In a further preferred embodiment, the method desirably includes substeps of disposing a first piece of VELCRO® on the first extremity and disposing a second piece of VELCRO® on the second extremity of the elongated flexible body, wherein the first piece of VELCRO® is adapted to mate to and removably adhere to the second piece of VELCRO®.

In a second preferred embodiment, the instant invention contemplates an exercise apparatus comprising an elongated flexible body having a first extremity and a second extremity disposed to either side of a central portion and an elongated elastic member. The elongated elastic member includes a first end and a second end. The first and second ends are (i) adapted to accommodate a human limb and (ii) adapted to removably couple to the central portion of the elongated flexible body.

The exercise apparatus further desirably but not essentially comprises a plurality of ring structures disposed along an axis extending between the first extremity and the second extremity of the elongated flexible body, a first clip disposed at the first end of the elongated elastic member and a second clip disposed at the second end of the elongated elastic member, wherein the first and second clips are adapted to couple the first and the second ends of the elongated elastic member to ones of the plurality of ring structures.

The exercise apparatus preferably includes a piece of cloth material sewn to the elongated flexible body so as to permanently capture flat portions of D-rings and attach the D-rings along the axis extending between the first extremity and the second extremity of the elongated flexible body, and to the elongated flexible body, and the flexible elongated body desirably includes a flexible elongated cloth body.

The exercise apparatus desirably but not essentially further comprises a strap adapted to be coupled to an end of the elongated elastic member, wherein the strap has a length of between six inches and twelve inches, wherein the strap includes a first sewn bight at one extremity thereof, the first sewn bight capturing a ring coupled to a clip, wherein the strap includes a second sewn bight at another extremity thereof. The second sewn bight captures a D-ring adapted to couple to the clip to form a continuous closed loop.

The exercise apparatus usefully includes a strap adapted to be coupled to an end of the elongated elastic member and also usefully includes a strap having a grommet affixed thereto, wherein the grommet includes an interior diameter that is larger than an exterior diameter of the elongated elastic member and wherein the interior diameter is smaller than a knot tied in an end of the elongated elastic member.

The exercise apparatus optionally further comprises a protective layer disposed about a midsection of the elongated elastic member and the elongated elastic member optionally includes an elongated elastic member chosen from the group consisting of surgical tubing, rubber cord and woven elastic cord.

The exercise apparatus optionally includes the elongated flexible body having a first extremity and a second extremity disposed to either side of a central portion, including a first piece of VELCRO® disposed on the first extremity of the elongated flexible body and a second piece of VELCRO® disposed on the second extremity of the elongated flexible body, wherein the first piece of VELCRO® is adapted to mate to and removably adhere to the second piece of VELCRO®.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings, in which:

FIG. 1 is a schematic illustration of an exercise device that is illustrated as being coupled to a reclining chair, in accordance with the teachings of the instant invention;

FIG. 2 is a schematic illustration of the exercise device of FIG. 1 that is illustrated as being detached from any fixed object and that is illustrated as including an elastic member coupled at either end to the body of the exercise device, in accordance with the teachings of the instant invention;

FIG. 3 is a schematic illustration of the exercise device of FIGS. 1 and 2 that is illustrated as being detached from any fixed object and that is illustrated as including an elastic member coupled at either end to the body of the exercise device, illustrating a detachable coupling between two portions of the body of the exercise device, in accordance with the teachings of the instant invention;

FIG. 7 provides a view of the exercise device of FIGS. 1 through 6, illustrating a first step in a first exemplary exercise adapted to the present invention, in accordance with the teachings of the present invention;

FIG. 8 provides a view of the exercise device of FIGS. 1 through 6, showing a second step in the first exemplary exercise adapted to the instant invention, in accordance with the teachings of the instant invention;

FIG. 9 provides a view of the exercise device of FIGS. 1 through 6, demonstrating a first step in a second exemplary exercise adapted to the present invention, in accordance with the teachings of the present invention;

DETAILED DESCRIPTION OF THE PREFERRED EMBODIMENT

Figure 4:
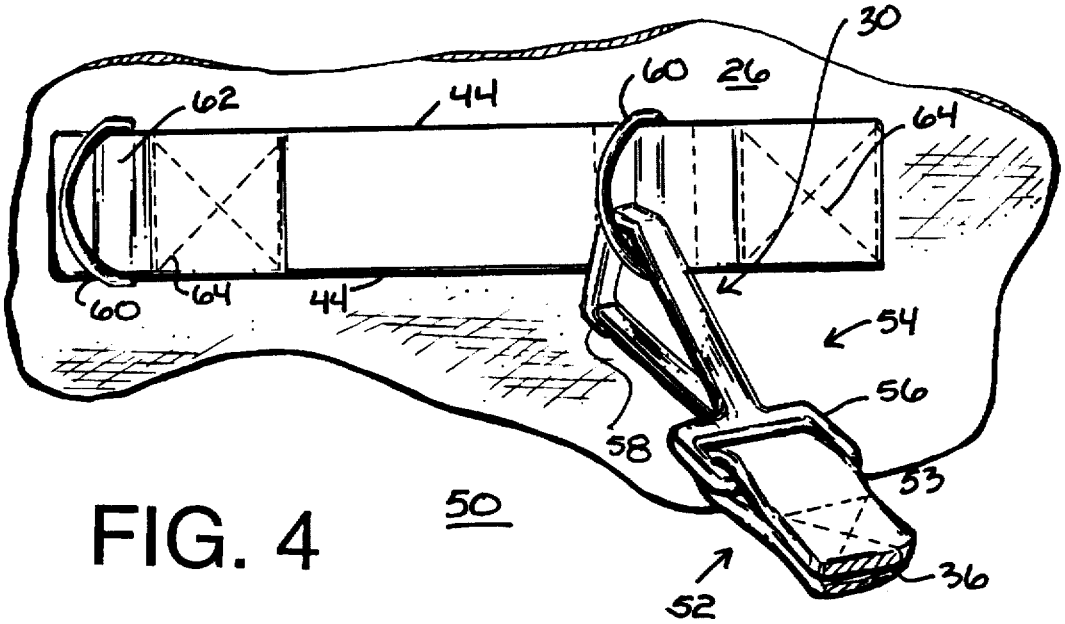
FIG. 4 provides an enlarged detail view of a portion of the exercise device 22 of FIGS. 1 through 3, showing a detachable coupling between the body of the exercise device and an elastic member, in accordance with the teachings of the instant invention.

The discussion of the instant invention is provided in three parts, with § I providing a physical description of the exercise device 22 of the instant invention and § II describing three exemplary exercises (§§ II A, II B and II C, see FIGS. 7 through 12 and associated text, infra) that may be carried out with the aid of the exercise device 22 of the present invention. In § III, conclusions and additional observations describing preferred embodiments are provided. It will be appreciated by those of skill in the relevant arts that other arrangements and exercises are included in the spirit and scope of this disclosure.

§ I. PHYSICAL DESCRIPTION OF A PREFERRED EMBODIMENT

The discussion of § I is divided into two components. The first section, § I A, provides an overview of the exercise device 22 (see FIGS. 1 through 3 and associated text, infra). The second section, § I B, illustrates subassemblies of the exercise device 22 in more detail (see FIGS. 4 through 6 and associated text, infra).

§ I A. Overview

Turning now to the drawings, in which like reference characters indicate corresponding elements throughout the several views, attention is first directed to FIG. 1 which illustrates the exercise device 22 coupled to a chair 24, generally collectively designated by the reference character 20, for exercising in accordance with the teachings of the instant invention. The exercise device 22 includes an elongated flexible body 26 and an elastic member 28 detachably coupled to the elongated flexible body 26 by one or more detachable couplings 30, which detachable couplings 30 are discussed in more detail in conjunction text associated with FIG. 4, infra.

It will be appreciated that the chair 24 of FIG. 1 may be usefully employed for the intended purposes thereof despite attachment of the elongated flexible body 26 of the exercise device 22 to the back of the chair 24 and that the presence of the elastic member 28 in the seat of the chair 24 also does not interfere with normal use of the chair 24. In other words, the exercise device 22 need not be "taken down" and stored between usages or exercise sessions, but rather may be left coupled to the back of the chair 24 between uses. This arrangement also lends itself to interruptions in use of the exercise device 22, for example, when the doorbell rings or when the person using the exercise device has other domestic errands to attend to, even those types of domestic concerns or errands that require only sporadic attention and activity.

Turning now to FIG. 2, a schematic illustration of the exercise device 22 of FIG. 1 is provided, with the exercise device 22 shown as being detached from any other fixed object. The exercise device 22 includes an elastic member 28 coupled at either end 30 to the elongated flexible body 26 of the exercise device 22, in accordance with the teachings of the instant invention. The elastic member 28 is desirably fitted with straps 32 at either end 36 thereof. This is usefully effectuated by passing each of the ends 36 of the elastic member 28 through a grommet 34 disposed at a first end of each strap 32 and securing the ends 36 by tying a knot (not illustrated in FIG. 2) therein that cannot pass through the grommet 34. The straps 32 also desirably include a second grommet 38 disposed at a second end thereof. The elastic member 28 also desirably includes a protective layer 35 in the form of tubing that is slipped over the elastic member 28 prior to attachment of at least one of the straps 32 to the ends 36. The protective layer 35 is discussed in more detail in text associated with FIGS. 7 and 8, infra.

With reference now to FIG. 3, a schematic illustration of the exercise device 22 of FIGS. 1 and 2 is shown, with the exercise device 22 being shown as being detached from any fixed object and including an elastic member 28 coupled at either end to the elongated flexible body 26 of the exercise device 22. FIGS. 2 and 3 illustrate a detachable coupling 41 between two end portions 40 and 40' of the elongated flexible body 26 of the exercise device 22, in accordance with the teachings of the instant invention.

The detachable coupling 41 is desirably effectuated by including mating VELCRO® surfaces 42 and 42' disposed on the ends 40 and 40' of the elongated flexible body 26 of the exercise device 22. The straps 32 are detachably coupled to loops 44 that are affixed, preferably by sewing, to the elongated flexible body 26 of the exercise device 22, and this is illustrated in more detail in FIG. 4 to follow.

§ I B. Detailed Description of Subassemblies

Directing attention now to FIG. 4, an enlarged detail view of a portion 50 of the exercise device 22 of FIGS. 1 through 3 is illustrated, showing the detachable coupling 30 between the elongated flexible body 26 of the exercise device 22 and the elastic member 28, in accordance with the teachings of the instant invention. The portion 50 desirably includes the loops 44 that are attached to the elongated flexible body 26 of the exercise device 22. The loops 44 include openings 62 through which the flat of a D-ring 60 may pass and that secure the D-rings 60 via stitching 64 that forms the openings 62.

Clips 54 having a ring portion 56 and a clip portion 58 are secured to the ends 53 of the strap 32 by forming a bight 52 at the end 53 of the strap 32 and sewing the bight 52 shut about the ring portion 56. This arrangement allows the strap 32 to be detachably coupled to the D-rings 60 disposed on the elongated flexible body 26 of the exercise device 22 in a readily reconfigurable manner that is also robust, that is, that will not pull out or separate easily or accidentally in the course of normal use of the exercise device 22. Manipulation of the clip portion 58, however, allows and facilitates convenient and rapid reconfiguration of the relationship between the elongated flexible body portion 26 and the elastic member 28.

It will also be appreciated that other types of releasable couplings could be usefully employed in lieu of clips 54 and D-rings 60. For example, bayonet-type clips, one-quarter turn spring-loaded fasteners and the like could be used to effectuate rapidly-releasable, convenient and useful de- and re-attachable couplings.

Figure 5:
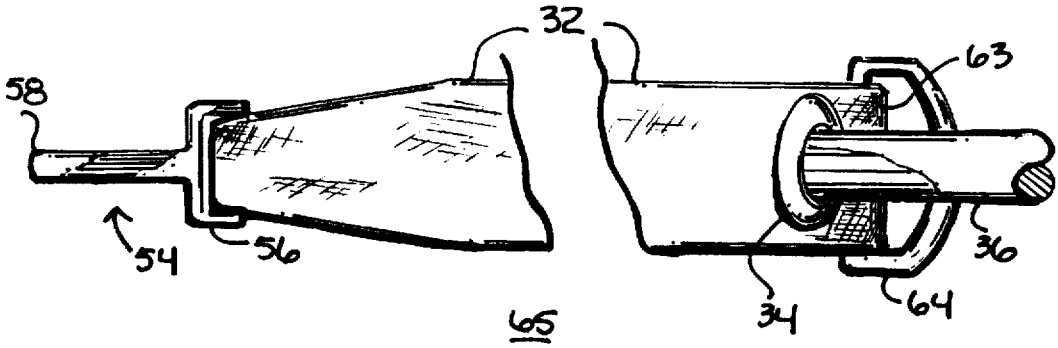
FIG. 5 provides an enlarged detail side view of a portion of the exercise device of FIGS. 1 through 3, illustrating a strap in a first position, wherein the strap is designed to be coupled to a limb, in accordance with the teachings of the instant invention.

Directing attention now to FIG. 5, an enlarged detail side view of a portion 65 of the exercise device 22 of FIGS. 1 through 3 is provided, illustrating the strap 32 in a first position, wherein the strap 32 is designed to be coupled to a limb or a fixed object, in accordance with the teachings of the instant invention. The end 36 of the elastic member 28 is coupled to the strap 32 at a first end thereof via the grommet 34 and, for example, a knot (not illustrated in FIG. 5) disposed at the terminus of the end 36 of the elastic member 28. Adjacent the grommet 34 is a first sewn bight 63 capturing a flat portion of a D-ring 64. The first sewn bight 63 is similar to the sewn bight 52 of FIG. 4, supra. At a second end of the strap 32, the clip 54 having the ring portion 56 and the clip portion 58 is usefully disposed.

Figure 6:
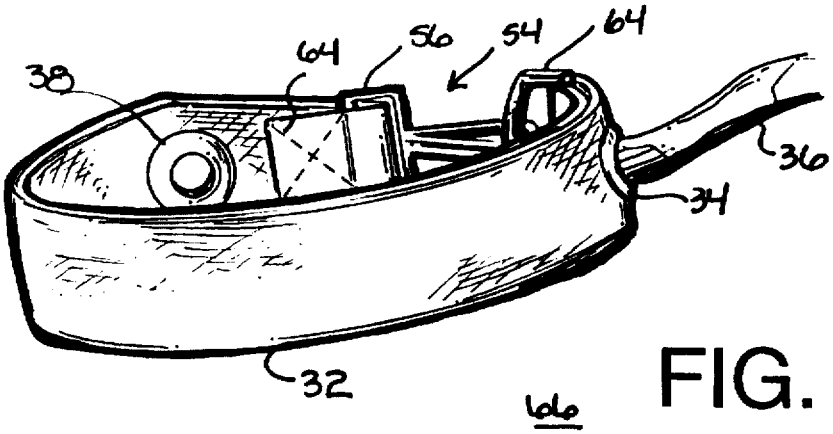
FIG. 6 provides an enlarged detail isometric view of a portion of the exercise device of FIGS. 1 through 3, depicting the strap of FIG. 5 in a second position, wherein the strap is designed to be coupled to a limb, in accordance with the teachings of the instant invention.

Now with reference to FIG. 6, an enlarged detail isometric view of a portion 66 of the exercise device 22 of FIGS. 1 through 3 is given, showing the strap 32 of FIG. 5 in a second position, wherein the strap 32 is designed to be coupled to a limb, in accordance with the teachings of the instant invention. The view of FIG. 6 illustrates coupling of the clip portion 58 of the clip 54 to the D-ring 64 to form a continuous closed loop disposed at an end 36 of the elastic member 28. The continuous closed loop is of a size that is adapted to accommodating a limb, such as a hand or a foot, for example, for facilitating especially those types of exercises wherein one portion of the body pulls against another, although this same arrangement also permits pulling against a fixed object (e.g., a doorknob). An exercise employing this capability of the exercise device 22 of FIGS. 1 through 6, supra, is provided in conjunction with text associated with FIGS. 7 and 8, infra.

§ II. EXEMPLARY EXERCISES USING THE INSTANT INVENTION

Figure 10:
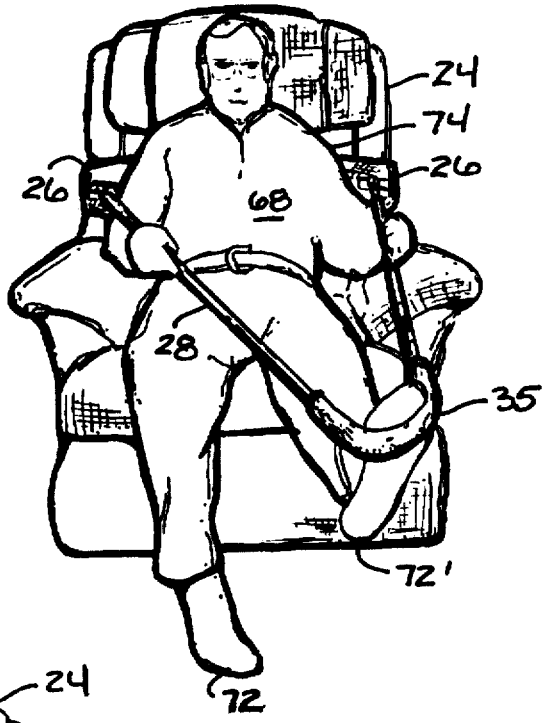
FIG. 10 provides a view of the exercise device of FIGS. 1 through 6, depicting a second step in the second exemplary exercise adapted to the instant invention, in accordance with the teachings of the instant invention.

The discussion accompanying FIGS. 7 and 8, infra, provides a description of a first exercise that may be carried out employing the exercise device 22 of FIGS. 1 through 6 in § II A, infra, while the discussion accompanying FIGS. 9 and 10, infra, provides a description of a second exercise that may be carried out employing the exercise device 22 of FIGS. 1 through 6 in § II B, infra. A third exercise that may be carried out with the exercise device 22 of FIGS. 1 through 6 is described in conjunction with FIGS. 11 and 12, infra, in § II C, infra.

§ II A. A First Exemplary Exercise

Turning now to FIG. 7, a view of the exercise device 22 of FIGS. 1 through 6 is provided, illustrating a first step in a first exemplary exercise adapted to the present invention, in accordance with the teachings of the present invention. The first exemplary exercise employs the strap 32 in the configuration of FIG. 6 to exercise, strengthen and tone upper body muscles such as the triceps, biceps and forearm and hand muscles and also ankle, knee and leg muscles. In this configuration, the elongated flexible body 26 of the exercise device 22 is detached from, and does not interact with, the elastic member 28.

A person 68 places one strap 32 in either hand 70 and 70' and places a foot 72 in the central portion of elastic member 28, preferably upon protective layer 35. This is accomplished with the knee 73 extended (as shown in FIG. 7) or with the knee 73 drawn up towards the torso 74 (not illustrated).

With reference now to FIG. 8, a view of the exercise device 22 of FIGS. 1 through 6 is illustrated, showing a second step in the first exemplary exercise adapted to the instant invention, in accordance with the teachings of the instant invention. In this second step, the person 68 draws the ends 36 of the elastic member 28 up towards the torso 74 via the straps 32, exercising the biceps, forearms and hand muscles against those associated with the foot 72. The person 68 then relaxes back to the state illustrated in FIG. 7. The motions shown in FIGS. 8 and 7 are then alternately repeated to complete a portion of an exercise or physical therapy session.

Alternatively, the person 68 may elect to draw the knee 73 up to the torso 74 while in a posture similar to that illustrated in FIG. 7. The person may then extend the knee 73, pushing the foot 72 against the resistance of the elastic member 28 in combination with the resistance provided by the hands 70 and 701, thus exercising not only the biceps, forearms and hand muscles but as well the knee, thigh and/or ankle muscles associated with the foot 72 (or feet 72 and 72', when both feet 72 and 72' are placed upon the protective layer 35 of the elastic member 28). Again, the person 68 relaxes back to the first state, analogous to that illustrated in FIG. 7, and then repeats the motions described in these paragraphs to complete an exercise session. These types of exercises may be carried out with an elastic member 28 of a length suitable to the specific exercise of interest and an exercise device 22 may usefully include a plurality of elastic members 28 of differing lengths, each adapted to a particular person's body geometry and exercise or physical therapy needs.

The preceding exercises employ the elastic member 28, straps 32 and protective layer 35 in a stand-alone configuration that permits a person 68 to exercise various muscle groups while sitting or in any other convenient position. The next set of exercises is described in conjunction with FIGS. 9 and 10, infra, and these exercises employ the elastic member 28 and straps 32 in combination with the elongated flexible body 26 and, as illustrated in FIGS. 9 and 10, with the chair 24.

§ II B. A Second Exemplary Exercise

Directing attention now to FIG. 9, a view of the exercise device 22 of FIGS. 1 through 6 is provided, demonstrating a first step in a second exemplary exercise adapted to the present invention, in accordance with the teachings of the present invention. The second exemplary exercise employs the strap 32 in the configuration of FIG. 5 to exercise, strengthen and tone lower body muscles such as ankle, knee, thigh, calf and other leg muscles. In this configuration, the elongated flexible body 26 of the exercise device 22 is attached to, and interacts with, the elastic member 28.

A person 68 couples one strap 32 to those of loops 44 that are affixed, preferably by sewing, symmetrically with respect to the ends of the elongated flexible body 26 of the exercise device 22 and places a foot 72 in the central portion of elastic member 28, preferably upon protective layer 35. This is accomplished with the knee 73 drawn up towards the torso 74 (as shown in FIG. 9).

Attention is now drawn to FIG. 10, which provides a view of the exercise device 22 of FIGS. 1 through 6, depicting a second step in the second exemplary exercise adapted to the instant invention, in accordance with the teachings of the instant invention. In this second step, the person 68 pushes the central portion of the elastic member 28 including the protective covering 35 away from the torso 74 via the protective covering 35 with the foot 72' or 72, exercising the muscles associated with the foot 72' or 72 against the back of the chair 24. The person 68 then relaxes back to the state illustrated in FIG. 9. The motions shown in FIGS. 10 and 9 are then alternately repeated to complete a portion of an exercise or physical therapy session.

§ II C. A Third Exemplary Exercise

Figure 11:
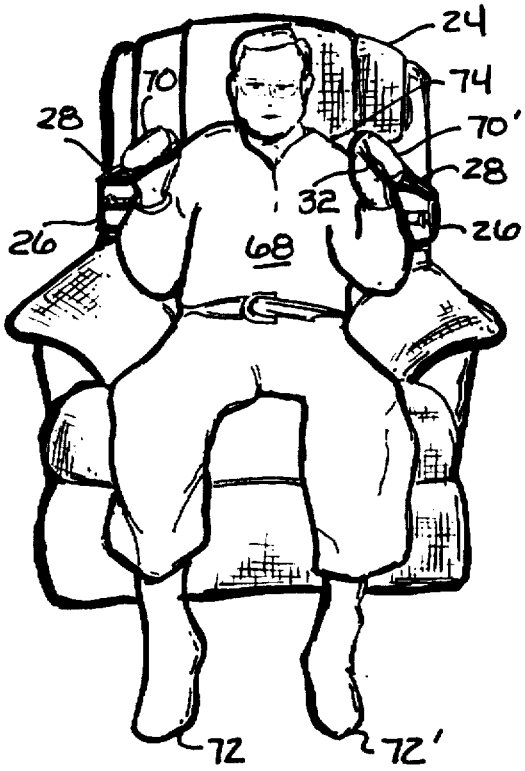
FIG. 11 provides a view of the exercise device of FIGS. 1 through 6, showing a first step in a third exemplary exercise adapted to the present invention, in accordance with the teachings of the present invention.

Now with reference to FIG. 11, a view of the exercise device 22 of FIGS. 1 through 6 is illustrated, showing a first step in a third exemplary exercise adapted to the present invention, in accordance with the teachings of the present invention. The third exemplary exercise employs the strap 32 in the configuration of FIG. 5 to exercise, strengthen and tone upper body muscles such as the triceps, biceps and forearm and hand muscles and also back, stomach and side muscles. In this configuration, the elongated flexible body 26 of the exercise device 22 is detached from, and does not interact with, the elastic member 28.

A person 68 places one strap 32 in either hand 70 and 70' and places the central portion of elastic member 28 about the back of the chair 24. This is accomplished with the hands 70 and 70' drawn up towards the torso 74 (as illustrated in FIG. 11).

Figure 12:
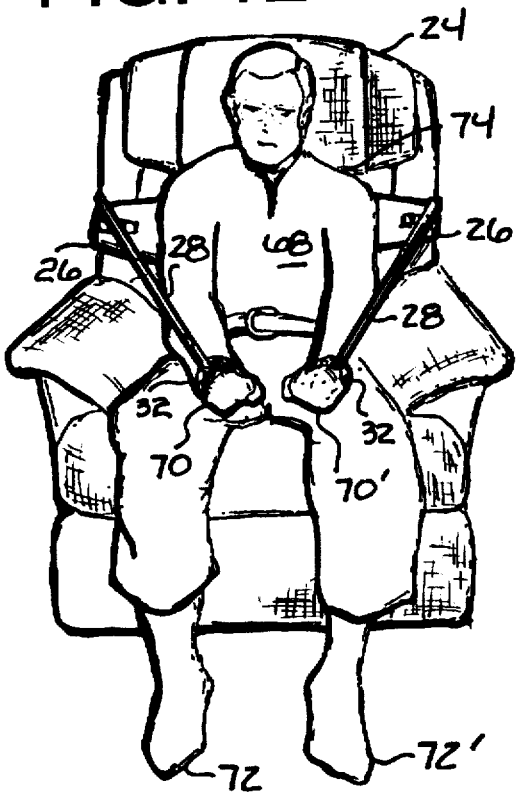
FIG. 12 provides a view of the exercise device of FIGS. 1 through 6, illustrating a second step in the third exemplary exercise adapted to the instant invention, in accordance with the teachings of the instant invention.

Directing attention now to FIG. 12, a view of the exercise device 22 of FIGS. 1 through 6 is given, illustrating a second step in the third exemplary exercise adapted to the instant invention, in accordance with the teachings of the instant invention. In this second step, the person 68 pushes the straps 32 away from the torso 74, stretching the elastic member 28 and thereby exercising the biceps, forearms and hand muscles against the back of the chair 24. The person 68 then relaxes back to the state illustrated in FIG. 11. The motions shown in FIGS. 12 and 11 are then alternately repeated to complete a portion of an exercise or physical therapy session.

Alternatively, the person 68 may elect to draw the torso 74 away from the back of the chair 24 while in a posture similar to that illustrated in FIG. 11. By bending the back against the resistance of the elastic member 28 in combination with the resistance provided by the hands 70 and 70', the person 68 exercises not only the back, stomach and side muscles but as well the biceps, forearms and hand muscles. Again, the person 68 relaxes back to the first state, analogous to that illustrated in FIG. 11, and then repeats the motions described in this paragraph to complete an exercise session.

§ III. CONCLUSION

It will be appreciated that many different types of materials could be usefully employed to provide elastic member 28. Surgical tubing tends to be quite elastic and rugged, but is often sufficiently thin that protective layer 35 also doubles to provide a broader "grip" and so to avoid having the elastic member 28 dig into the flesh of the person 68 who is exercising with the exercise device 22. Bungee cords or shock cords comprising either a length of rubber or a woven elastic cord also find application as elastic member 28. Various types of plastic tubing having an internal diameter greater than the external diameter of elastic member 28 in the unstretched state are useful for providing protective layer 35.

Additionally, it will be appreciated that the elongated flexible body 26 may be fashioned from a wide variety of fabrics such as Nylon, cotton, canvas and the like.

In a preferred embodiment of the instant invention, mating portions of the ends 40 and 40' of the elongated flexible body 26 of the exercise device 22 are provided with mating portions of VELCRO® to provide a simple way of attaching the elongated flexible body 26 to, for example, the back of a chair 24. These choices of materials allow the elongated flexible body 26 of the exercise device 22 to be very lightweight and also to be machine washable. The latter is noteworthy because regular use of the exercise device 22 may cause perspiration to be deposited thereon.

The foregoing detailed description of the instant invention for the purposes of explanation have been particularly directed toward exercise in the context of the home. It will be appreciated that the instant invention is equally useful exercise in the office and especially when traveling, because of the light weight and small size possible with the present invention's approach to making an exercise device 22.

Various changes and modifications to the embodiment herein chosen for purposes of illustration will readily occur to those skilled in the art. For example, alternatives to the coupling arrangements described in conjunction with FIGS. 4 through 6 and associated text may be desired for a specific application. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A method for making an exercise device, said method comprising steps of:

providing an elongated flexible body having a first extremity and a second extremity disposed to either side of a central portion;

providing an elongated elastic member, said elongated elastic member having a first end and a second end, said first and second ends (i) adapted to accommodate a human limb and (ii) adapted to removably couple to said central portion of said elongated flexible body;

disposing a plurality of ring structures along an axis extending between said first extremity and said second extremity of said elongated flexible body;

disposing a first clip at said first end of said elongated elastic member;

disposing a second clip at said second end of said elongated elastic member, wherein said first and second clips are adapted to couple said first and said second ends of said elongated elastic member to ones of said plurality of ring structures;

providing a first strap adapted to be coupled to said first end of said elongated elastic member, said first strap having a first bight at one extremity thereof, said first bight capturing a ring coupled to said first clip, wherein said first strap includes a second bight at another extremity thereof, said second bight capturing a ring adapted to couple to said first clip to form a continuous closed loop; and providing a second strap adapted to be coupled to said second end of said elongated elastic member, said second strap having a first bight at one extremity thereof, said first bight capturing a ring coupled to said second clip, wherein said second strap includes a second bight at another extremity thereof, said second bight capturing a ring adapted to couple to said second clip to form a continuous closed loop.

2. The method of claim 1, wherein said step of providing a first strap adapted to be coupled to said first end of said elongated elastic member includes a step of providing a strap having a grommet affixed thereto, wherein said grommet includes an interior diameter that is larger than an exterior diameter of said elongated elastic member, and wherein said interior diameter is smaller than a knot tied in said first end of said elongated elastic member.

3. The method of claim 1, wherein said step of providing a second strap adapted to be coupled to said second end of said elongated elastic member includes a step of providing a strap having a grommet affixed thereto, wherein said grommet includes an interior diameter that is larger than an exterior diameter of said elongated elastic member, and wherein said interior diameter is smaller than a knot tied in said second end of said elongated elastic member.

4. The method of claim 1, further including a steps of:

providing a protective layer; and disposing said protective layer about a midsection of said elongated elastic member.

5. The method of claim 1, wherein said step of providing an elongated elastic member further includes a step of providing an elongated elastic member chosen from the group consisting of surgical tubing, rubber cord and woven elastic cord.

6. The method of claim 1, wherein said step of providing an elongated flexible body having a first extremity and a second extremity disposed to either side of a central portion includes substeps of:

disposing a first piece of hook and loop material on said first extremity of said elongated flexible body; and disposing a second piece of hook and loop material on said second extremity of said elongated flexible body, wherein said first piece of hook and loop material is adapted to mate to and removably adhere to said second piece of hook and loop material.

7. An exercise apparatus, comprising:

an elongated flexible body having a first extremity and a second extremity disposed to either side of a central portion;

an elongated elastic member, said elongated elastic member having a first end and a second end, said first and second ends (i) adapted to accommodate a human limb and (ii) adapted to removably couple to said central portion of said elongated flexible body;

a plurality of ring structures disposed along an axis extending between said first extremity and said second extremity of said elongated flexible body;

a first clip disposed at said first end of said elongated elastic member;

a second clip disposed at said second end of said elongated elastic member, wherein said first and second clips are adapted to couple said first and said second ends of said elongated elastic member to ones of said plurality of ring structures;

a first strap adapted to be coupled to said first end of said elongated elastic member, said first strap having a first bight at one extremity thereof, said first bight capturing a ring coupled to said first clip, wherein said first strap includes a second bight at another extremity thereof, said second bight capturing a ring adapted to couple to said first clip to form a continuous closed loop; and a second strap adapted to be coupled to said second end of said elongated elastic member, said second strap having a first bight at one extremity thereof, said first bight capturing a ring coupled to said second clip, wherein said second strap includes a second bight at another extremity thereof, said second bight capturing a ring adapted to couple to said second clip to form a continuous closed loop.

8. The exercise apparatus of claim 7, wherein said first strap includes a strap having a grommet affixed thereto, wherein said grommet includes an interior diameter that is larger than an exterior diameter of said elongated elastic member, and wherein said interior diameter is smaller than a knot tied in said first end of said elongated elastic member.

9. The exercise apparatus of claim 7, wherein said second strap includes a strap having a grommet affixed thereto, wherein said grommet includes an interior diameter that is larger than an exterior diameter of said elongated elastic member, and wherein said interior diameter is smaller than a knot tied in said second end of said elongated elastic member.

10. The exercise apparatus of claim 7, further including a protective layer disposed about a midsection of said elongated elastic member.

11. The exercise apparatus of claim 7, wherein said elongated elastic member includes an elongated elastic member chosen from the group consisting of surgical tubing, rubber cord and woven elastic cord.

12. The exercise apparatus of claim 7, wherein said elongated flexible body having a first extremity and a second extremity disposed to either side of a central portion further includes:

a first piece of hook and loop material disposed on said first extremity of said elongated flexible body; and a second piece of hook and loop material disposed on said second extremity of said elongated flexible body, wherein said first piece of hook and loop material is adapted to mate to and removably adhere to said second piece of hook and loop material.

13. For use with a chair of a type having a seat with a seating surface supported above the ground by a base, and a back with a back surface extending upwardly from the seat, the seat surface and the back surface operative for accommodating a user in a seated position, an exercise apparatus, comprising:

an elongated flexible body engagable to the back of the chair, said elongated flexible body having, a first extremity, a second extremity disposed to either side of a central portion of said elongated flexible body, an engagement element carried by said first extremity, and a complemental engagement element carried by said second extremity, said elongated flexible body for wrapping engagement about said back with said central portion positioned adjacent said back surface, said engagement element detachably engagable to said complemental engagement element for detachably engaging said first extremity to said second extremity for detachably bounding said elongated flexible body to the back of the chair;

an elongated elastic member having a first end and a second end, said first and second ends movable between a first configuration for accommodating a human limb for allowing the user to engage in a first mode of exercise while seated upon the chair and a second position for detachably engaging said central portion of said elongated flexible body for allowing the user to engage in a second mode of exercise while seated upon the chair, said first mode of exercise being different than said second mode of exercise;

a first engagement element carried proximate said first end of said elongated elastic member;

a second engagement element carried proximate said second end of said elongated elastic member;

a first complemental engagement element carried by said elongated flexible body along an axis extending between said first extremity and said second extremity of said elongated flexible body;

a second complemental engagement element, spaced from said first complemental engagement element, carried by said elongated flexible body along the axis extending between said first extremity and said second extremity of said elongated flexible body;

said first engagement element operative for detachably engaging said first end of said elongated elastic member to said first complemental engagement element, and said second engagement element operative for detachably engaging said second end of said elongated elastic member to said second complemental engagement element.

14. The exercise apparatus of claim 13, wherein said first engagement element includes a first clip.

15. The exercise apparatus of claim 13, wherein said second engagement element includes a second clip.

16. The exercise apparatus of claim 14, wherein said first complemental engagement element includes a first ring structure, said first clip adapted to detachably couple said first ring structure.

17. The exercise apparatus of claim 15, wherein said second complemental engagement element includes a second ring structure, said second clip adapted to detachably couple said second ring structure.

18. The exercise apparatus of claim 14, further including a first elongated strap adapted to be coupled to the first end of said elongated elastic member, said first elongated strap having:

a first bight at one extremity thereof for capturing a ring coupled to said first clip, a second bight at another extremity thereof, said second bight capturing a ring element adapted to detachably couple to said first clip to form a continuous closed loop operative for accommodating a human limb.

19. The exercise apparatus of claim 15, further including a second elongated strap adapted to be coupled to the second end of said elongated elastic member, said second elongated strap having:

a first bight at one extremity thereof for capturing a ring coupled to said second clip, a second bight at another extremity thereof, said second bight capturing a ring element adapted to detachably couple to said second clip to form a continuous closed loop operative for accommodating a human limb.

20. The exercise apparatus of claim 16, wherein said first ring structure includes first rings mounted to said elongated flexible body along said axis extending between said first extremity and said second extremity of said elongated flexible body.

21. The exercise apparatus of claim 17, wherein said second ring structure includes second rings mounted to said elongated flexible body along said axis extending between said first extremity and said second extremity of said elongated flexible body.

22. The exercise apparatus of claim 13, further including a protective layer disposed about a midsection of said elongated elastic member.

23. The exercise apparatus of claim 13, wherein said elongated elastic member includes an elongated elastic member chosen from the group consisting of surgical tubing, rubber cord and woven elastic cord.

24. A method for making an exercise device, said method comprising steps of:

providing an elongated flexible body having a first extremity and a second extremity disposed to either side of a central portion;

providing an elongated elastic member, said elongated elastic member having a first end and a second end, said first and second ends (i) adapted to accommodate a human limb and (ii) adapted to removably couple to said central portion of said elongated flexible body;

disposing a plurality of ring structures along an axis extending between said first extremity and said second extremity of said elongated flexible body by sewing a piece of cloth material to said elongated flexible body so as to permanently capture flat portions of D-rings and attach said D-rings along said axis extending between said first extremity and said second extremity of said elongated flexible body, and to said elongated flexible body;

disposing a first clip at said first end of said elongated elastic member;

disposing a second clip at said second end of said elongated elastic member, wherein said first and second clips are adapted to couple said first and said second ends of said elongated elastic member to ones of said plurality of ring structures;

providing a strap adapted to be coupled to an end of said elongated elastic member, wherein said strap has a length of between six inches and twelve inches, wherein said strap includes a first sewn bight at one extremity thereof, said first sewn bight capturing a ring coupled to a clip, wherein said strap includes a second sewn bight at another extremity thereof, said second sewn bight capturing a D-ring adapted to couple to said clip to form a continuous closed loop;

providing a grommet affixed to said strap, wherein said grommet includes an interior diameter that is larger than an exterior diameter of said elongated elastic member, and wherein said interior diameter is smaller than a knot tied in an end of said elongated elastic member; and providing a protective layer disposed about a midsection of said elongated elastic member.

25. A method as claimed in claim 24, wherein said step of providing an elongated elastic member includes a step of providing an elongated elastic member chosen from the group consisting of surgical tubing, rubber cord and woven elastic cord; and wherein said step of providing an elongated flexible body having a first extremity and a second extremity disposed to either side of a central portion includes substeps of:

disposing a first piece of VELCRO® on said first extremity; and disposing a second piece of VELCRO® on said second extremity, wherein said first piece of VELCRO® is adapted to mate to and removably adhere to said second piece of VELCRO®.

* * * * *